US011096451B2

(12) United States Patent
Shizuma

(10) Patent No.: US 11,096,451 B2
(45) Date of Patent: Aug. 24, 2021

(54) COMBINATION OF CLOTHING AND ORNAMENTS FOR CLOTHING

(71) Applicant: SHIWORI COMPANY, LIMITED, Tokyo (JP)

(72) Inventor: Rei Shizuma, Tokyo (JP)

(73) Assignee: SHIWORI COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/649,252

(22) PCT Filed: Oct. 23, 2018

(86) PCT No.: PCT/JP2018/039288
§ 371 (c)(1),
(2) Date: Mar. 20, 2020

(87) PCT Pub. No.: WO2019/187276
PCT Pub. Date: Oct. 3, 2019

(65) Prior Publication Data

US 2020/0288816 A1 Sep. 17, 2020

(30) Foreign Application Priority Data

Mar. 30, 2018 (JP) ..... JP2018-067215

(51) Int. Cl.
*A44B 1/04* (2006.01)
*A44B 13/00* (2006.01)

(52) U.S. Cl.
CPC ..... *A44B 1/04* (2013.01); *A44B 13/0035* (2013.01)

(58) Field of Classification Search
CPC .... A44B 1/04; A44B 1/34; A44B 1/42; A44B 13/0035; Y10T 24/3615
See application file for complete search history.

(56) References Cited

U.S. PATENT DOCUMENTS 20,707 A * 6/1858 Goodwin ..... A44B 1/34 24/98
65,250 A * 5/1867 McGill ..... A44B 1/42 24/96

(Continued)

FOREIGN PATENT DOCUMENTS

JP 47038214 B1 9/1972
JP 48111305 12/1973

(Continued)

OTHER PUBLICATIONS

International Search Report (PCT/ISA/210) dated Jan. 8, 2019, by the Patent Office as the International Searching Authority for International Application No. PCT/JP2018/039288.

(Continued)

*Primary Examiner* — Robert Sandy
*Assistant Examiner* — Rowland Do
(74) *Attorney, Agent, or Firm* — Buchanan Ingersoll & Rooney PC

(57) ABSTRACT

A one-side clothing fastening section and another-side clothing fastening sections being provided to face opposite each other and having no button insertion holes provided thereon, the one-side clothing fastening section and the other-side clothing fastening section being fastened together when the clothing is worn on a human body. Each of the ornaments for the clothing includes a button-like base portion having the decorative surface on the front side thereof; and a sharply protruding portion extending from and through the rear side of the button-like base portion and having a hook portion at the tip end side thereof. The sharply protruding portion being passed through the clothing from the front side to the rear side of the one-side clothing fastening section and then from the front side to the rear side of the other-side clothing fastening section.

5 Claims, 5 Drawing Sheets

(56) References Cited

U.S. PATENT DOCUMENTS

| | | | | | |
|---|---|---|---|---|---|
| 122,988 | A | * | 1/1872 | Bredt | A44B 1/04 24/114.9 |
| 232,044 | A | * | 9/1880 | Leszynsky | A44B 1/42 24/96 |
| 269,705 | A | * | 12/1882 | Prentice | A44B 1/42 24/96 |
| 289,830 | A | * | 12/1883 | Goddu | A44B 1/42 24/96 |
| 293,517 | A | * | 2/1884 | Prentice | A44B 1/42 24/96 |
| 303,664 | A | * | 8/1884 | Prentice | A44B 1/42 24/96 |

FOREIGN PATENT DOCUMENTS

| | | | |
|---|---|---|---|
| JP | 49-65405 | | 6/1974 |
| JP | 49076801 | | 7/1974 |
| JP | 51-143502 | | 11/1976 |
| JP | 52129506 | | 10/1977 |
| JP | 52-148213 | | 11/1977 |
| JP | 57-015208 | | 1/1982 |
| JP | 63-22109 | | 2/1988 |
| JP | 4-364802 | A | 12/1992 |
| JP | 11244011 | A | 9/1999 |
| JP | 3063604 | | 11/1999 |
| JP | 2006333891 | A | 12/2006 |
| JP | 2016073424 | A | 5/2016 |
| JP | 2016221161 | A | 12/2016 |

OTHER PUBLICATIONS

Decision to Grant a Patent issued in corresponding Japanese Patent Application No. 2018-067215, dated Aug. 30, 2018 (w/English Translation (5 pages).

* cited by examiner

COMBINATION OF CLOTHING AND ORNAMENTS FOR CLOTHING

BACKGROUND

Technical Field

The present invention relates to a combination of the clothing and the ornaments for the clothing. In particular, the present invention relates to a combination of the ornaments for the clothing which can be used as the fasteners for the clothing and the clothing on which no button insertion holes are provided in the clothing fastening portion.

Description of the Prior Art

It is known to the prior art that various forms of the combination of the clothing and the fasteners for the clothing have heretofore been proposed.

As one example, there is Patent Document 1 in which it is proposed that one pair of button body portions are provided on either side of the clothing so that both of the button body portions can appear outward or on the front side of the clothing and that the buttons, the button fastening structure, the clothing and the trousers or pants are designed so that they can be used as the reversible.

Patent Document 1: JP-A-2016-221161

SUMMARY OF THE INVENTION

An object of the present invention is to propose a combination of ornaments for clothing which can be used as fasteners for the clothing and a clothing on which no button insertion holes are provided in the clothing fastening portion of said clothing.

[1]

A combination of a clothing and ornaments for the clothing, wherein said ornaments for the clothing can be used as fasteners for the clothing and said clothing is composed of one-side front main section and other-side front main section both of which are passed through by said ornaments for the clothing and which will be fastened together when the clothing is worn on a human body, and has a clothing fastening portion, said clothing fastening portion including one-side clothing fastening section provided on the end side of said one-side front main section and other-side clothing fastening section provided on the end side of said other-side front main section, said one-side clothing fastening section and said other-side clothing fastening section being provided to face opposite each other when the clothing is worn on a human body, and having no button insertion holes provided thereon; and wherein each of said ornaments for the clothing includes:

a button-like base portion having ornamental or decorative surface on the front side thereof; and a sharply protruding portion extending from the rear side of the button-like base portion, said sharply protruding portion being passed through the clothing from the front side to the rear side of said one-side clothing fastening section and then from the front side to the rear side of said other-side clothing fastening section when the clothing is worn on a human body, and having a hook portion formed at the tip end side thereof.

[2]

A combination of the clothing and the ornaments for the clothing as defined in [1], wherein the hook portion formed at the tip end side of said sharply protruding portion is mounted to the tip end side of said sharply protruding portion and serves as a receiver for preventing said sharply protruding portion from being pulled out from the rear side toward the front side of said other-side clothing fastening section.

[3]

A combination of the clothing and the ornaments for the clothing as defined in [1], wherein the hook portion formed at the tip end side of said sharply protruding portion has its tip end side that is easy to become deformed or bent and by causing the tip end side to become deformed or bent, it will prevent said sharply protruding portion from being pulled out from the rear side toward the front side of said other-side clothing fastening section.

As one of its advantages, the present invention provides a combination of ornaments for clothing which can be used as fasteners for the clothing and a clothing on which no button insertion holes are provided in the clothing fastening portion of said clothing.

BEST MODE OF EMBODYING THE INVENTION

In the following description, the ornament or ornaments for the clothing may also be referred to as the clothing ornament or ornaments.

The clothing ornament 3 that can be used as the clothing fastener in accordance with the current embodiment is intended for being used as the fastener in the clothing fastening portion for the clothing 13.

Figure 1:
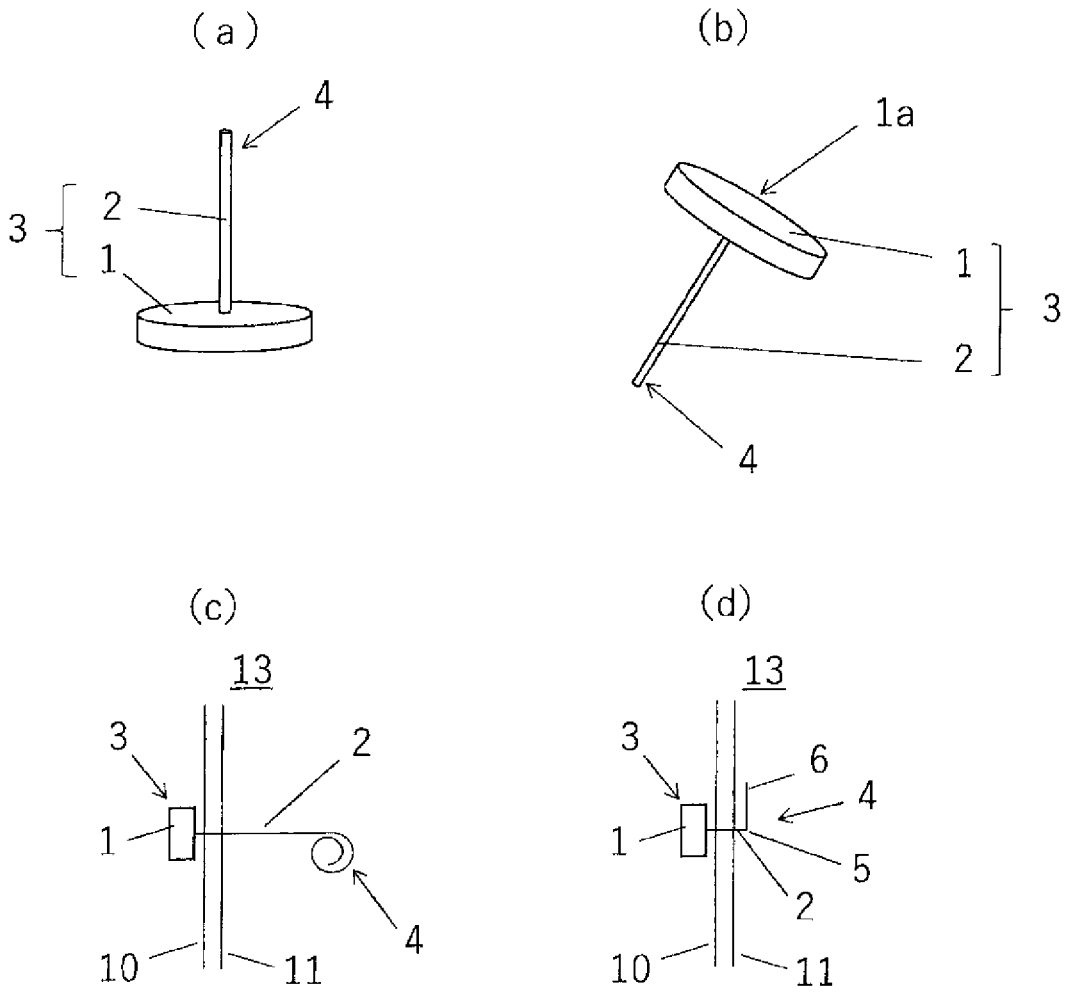
FIG. 1(*a*) is a perspective view of an ornament for clothing that can be used as the fastener for the clothing in accordance with one embodiment of the present invention, FIG. 1(*b*) is a perspective view of an ornament for clothing that can be used as the fastener for the clothing in accordance with one embodiment of the present invention when it is viewed from the direction different from the direction in FIG. 1(*a*), FIG. 1(*c*) is a schematic cross-sectional diagram of one example that illustrates how the ornament for clothing that can be used as the clothing fastener shown in FIG. 1(*a*) is used to cause the clothing fastening process to take place in the clothing fastening portion in order to fasten the clothing on which no button insertion holes are provided although some parts or portions are omitted, and FIG. 1(*d*) is a schematic cross-sectional diagram of another example that illustrates how the ornament for clothing that can be used as the clothing fastener shown in FIG. 1(*a*) is used to cause the clothing fastening process to take place in the clothing fastening portion in order to fasten the clothing on which no button insertion holes are provided although some parts or portions are omitted.
Figure 2:
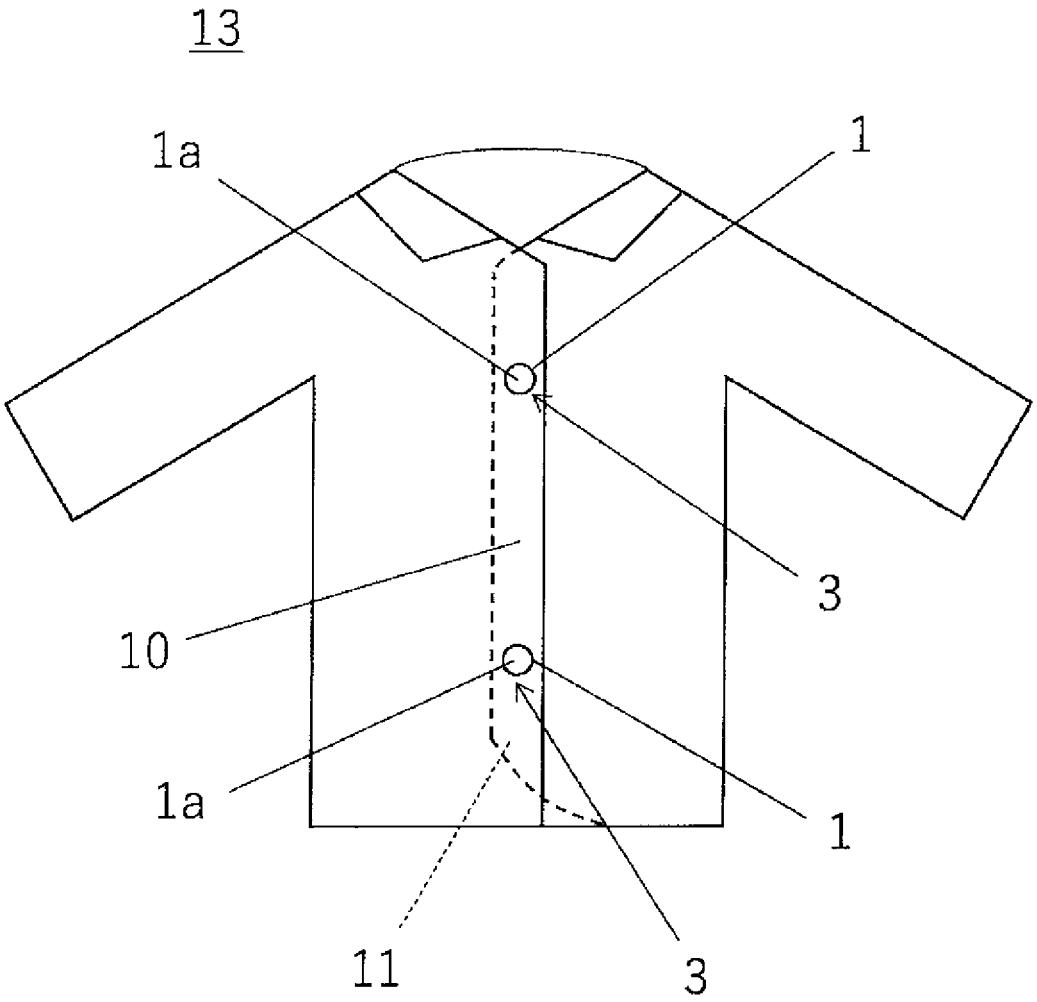
FIG. 2 is a front view of one example that illustrates how the ornament for clothing that can be used as the clothing fastener in accordance with the one embodiment of the present invention shown in FIG. 1 is used to cause the clothing fastening process to take place in the clothing fastening portion in order to fasten the clothing on which no button insertion holes are provided.

In the embodiment shown in FIG. 1, it is assumed that the clothing 13 has a clothing fastening portion in which the right-side front main section 10 in FIG. 2 and the left-side front main section 11 in FIG. 2 are to be fastened together on the respective end sides thereof and in which the clothing ornament 3 that can be used as the clothing fastener is used to fasten the clothing 13.

The clothing ornament 3 that can be used as the clothing fastener includes a button-like base portion 1 and a sharply protruding portion 2 extending from and through the rear side of the button-like base portion 1 (the upper side in FIG. 1(*a*)).

The sharply protruding portion 2 is provided so that it can be passed through the clothing 13 from its front side toward its rear side, and has the needle like slender bar form. As this will be described later, the tip end 4 of the sharply protruding portion 2 that has been passed through the clothing 13 from its front side toward its rear side will be subjected to deformation or bending, thereby preventing the sharply protruding portion 2 from being passed back through the clothing 13 from its rear side toward its front side. The sharply protruding portion 2 is thus prevented from being pulled out from the clothing 13. The sharply protruding portion 2 may be made of any materials such as metals, synthetic resin substances and any other similar materials that allow the tip end 4 to become deformed or bent easily, thereby preventing the sharply protruding portion 2 from being pulled out from the clothing 13 after its tip end 4 has become deformed or bent.

The side of the button-like base portion 1 on which the sharply protruding portion 2 is provided and which is opposite to the rear side thereof, that is, the surface 1*a* of the button-like base portion 1 of the clothing ornament 3 is the surface on which the decorations can appear. When the clothing ornament 3 in this embodiment is then used to fasten the clothing 13 as shown in FIG. 2, the surface 1*a* of the button-like base portion 1, which is exposed on the front side of the clothing 13 and serves as the decorative surface, can provide the highly enhanced decorative effects for the clothing 13.

Figure 5:
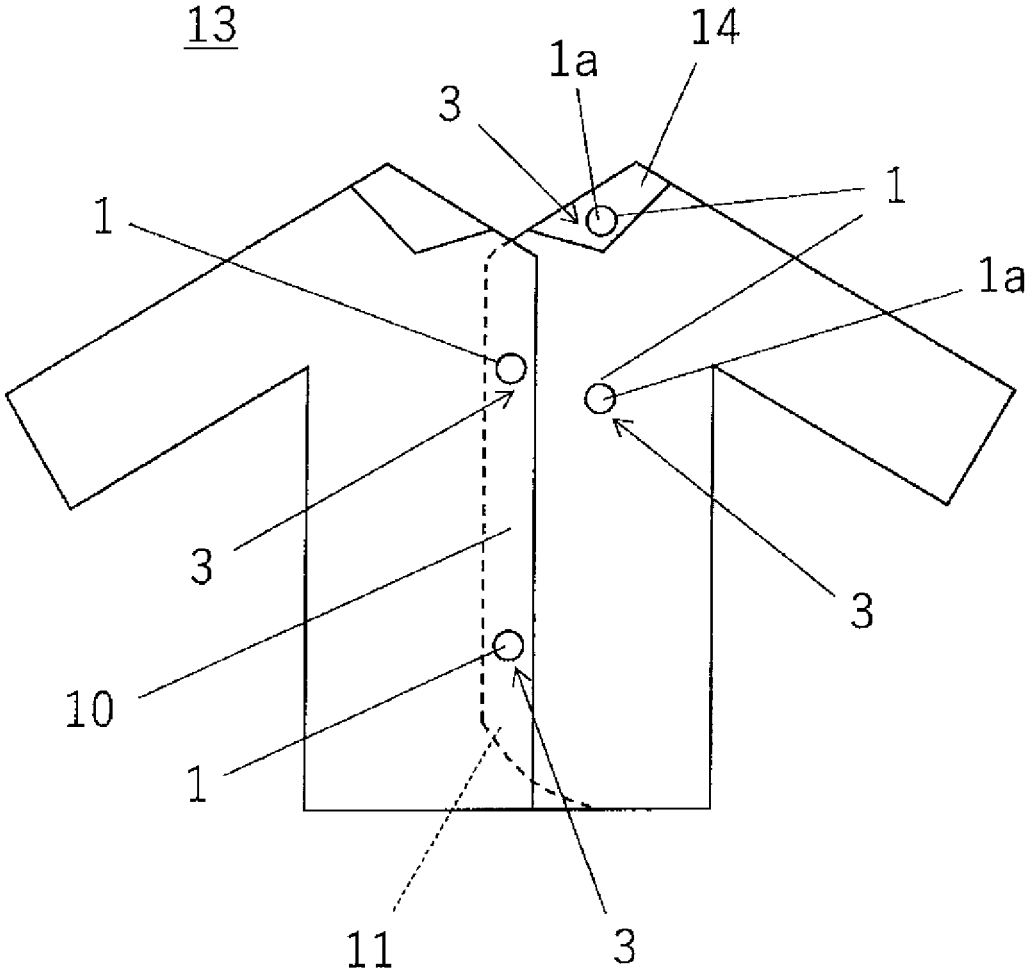
FIG. 5 is a front view of one example that illustrates how the ornament for clothing that can be used as the clothing fastener in accordance with one embodiment of the present invention is used to cause the clothing fastening process to take place in the clothing fastening portion in order to fasten the clothing on which no button insertion holes are provided and how the decorations are applied onto the clothing ornament.

For example, it is shown in FIG. 5 that by attaching the clothing ornament 3 to the collar 14 of the clothing 13 or to the chest and then by allowing the button-like base portion 1 of the clothing ornament 3 to appear on the surface 1*a*, the clothing 13 can provide the highly enhanced decorative effects.

In the embodiment shown in FIG. 1(*c*), (*d*) and FIG. 2, the end side of the right-side front main section 10 of the clothing 13 in FIG. 2 and the end side of the left-side front main section 11 of the clothing 13 in FIG. 2 overlap each other in the clothing fastening portion as shown in FIG. 1(*c*) and FIG. 2 and when the two front main sections 10 and 11 are placed in this overlapping state, the tip end 4 of the sharply protruding portion 2 is passed through the clothing 13 from the left side toward the right side thereof in FIGS. 1(*c*) and (*d*), that is, from the front side toward the rear side of the clothing 13.

By forming a hook portion on the tip end 4 of the sharply protruding portion 2 thus passed through the clothing 13, it is possible to prevent the sharply protruding portion 2 from being pulled out from the rear side toward the front side of the clothing 13.

Thus, the clothing ornament 3, which can be used as the clothing fastener as shown in FIGS. 1(*a*) and (*b*), is used as the clothing fastener in the clothing fastening portion.

As another form of the hook portion formed on the tip end 4 of the sharply protruding portion 2 thus passed through the clothing 13 from the front side toward the rear side thereof, there is a bent portion that may be formed on the tip end 4 of the sharply protruding portion 2 as shown in FIG. 1(*c*).

In the embodiment shown in FIG. 1(*c*), the tip end 4 of the sharply protruding portion 2 is coiled like a spring to prevent the sharply protruding portion 2 from being pulled out from the rear side toward the front side of the clothing 13.

In the embodiment shown in FIG. 1(*d*), the tip end 4 of the sharply protruding portion 2 is bent at the bending point 5 so that the tip 6 of the sharply protruding portion 2 can be extended from the bending point 5 in parallel to the front main section 11 of the clothing 13, thereby preventing the sharply protruding portion 2 from being pulled out from the rear side toward the front side of the clothing 13.

Figure 3:
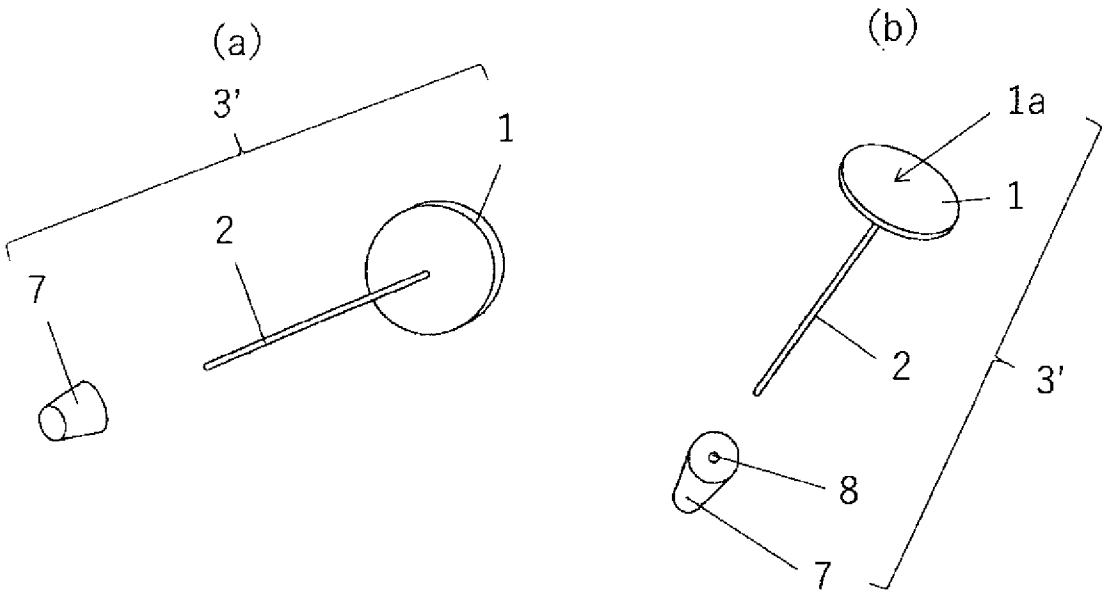
FIG. 3 (*a*) is a perspective view of an ornament for clothing that can be used as the clothing fastener in accordance with another embodiment of the present invention, FIG. 3(*b*) is a perspective view of the ornament for clothing that can be used as the clothing fastener in accordance with the another embodiment of the present invention when it is viewed from the direction different from the direction shown in FIG. 3 (*a*)

The embodiment shown in FIG. 3 is intended for explaining another embodiment of the hook portion formed on the tip end side of the sharply protruding portion 2.

By mounting a receiver 7 to the tip end of the sharply protruding portion 2, the receiver 7 will prevent the sharply protruding portion 2 from being pulled out from the rear side toward the front side of the clothing 13. In the illustrated embodiment, the receiver 7 has a fitting hole 8 into which the tip end of the sharply protruding portion 2 is to be fitted, and the tip end of the sharply protruding portion 2 thus passed through the two front main sections 10, 11 of the clothing 13 from the front side toward the rear side of the clothing 13 will be fitted into the fitting hole 8.

In this way, the clothing ornament 3' that includes the button-like base portion 1, the sharply protruding portion 2 extending from and through the rear side of the button-like base portion 1 and the receiver 7 mounted to the tip end of the sharply protruding portion 2 is used to fasten the clothing 13 in the clothing fastening portion.

Figure 4:
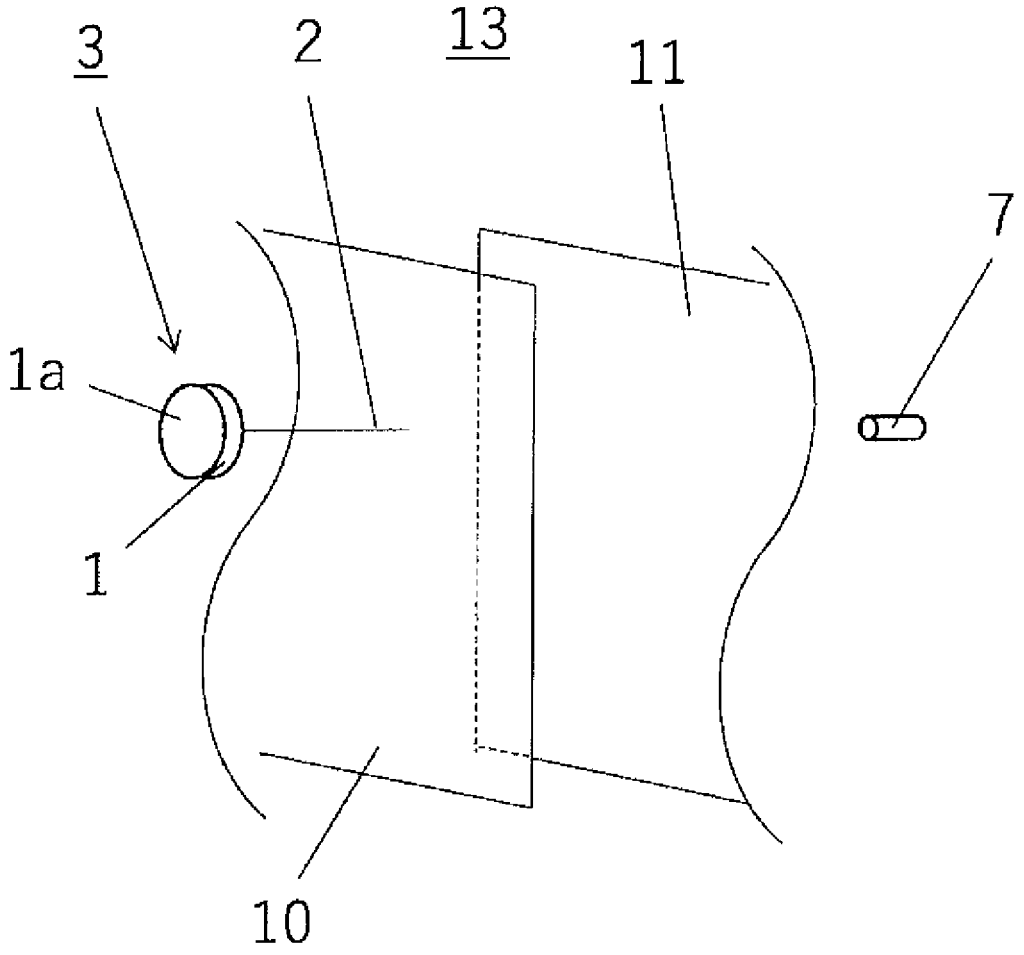
FIG. 4 is a schematic perspective diagram of the example that illustrates how the ornament for clothing that can be used as the clothing fastener shown in FIG. 3 is used to cause the clothing fastening process to take place in the clothing fastening portion in order to fasten the clothing on which no button insertion holes are provided although some parts or portions are omitted.

In the embodiment shown in FIGS. 3 and 4, it should be noted that the receiver 7 having the fitting hole 8 formed thereon into which the tip end of the sharply protruding portion 2 is to be fitted and the clothing ornament 3' which can be used as the clothing fastener can be interconnected by any connecting means (not shown) such as a string member, a series of chains, chains and the like, for example. The clothing ornament 3' and the receiver 7 may previously have been combined together.

For the embodiment shown in FIGS. 3 and 4, it is apparent from its schematic diagram in FIG. 4 that the sharply protruding portion 2 that has the needle-like slender bar form will be passed through the front main sections 10 and 11 of the clothing 13 from the front side toward the rear side thereof, and the hook portion will then be formed on the tip end side of the sharply protruding portion 2 after it has been passed through the clothing 13. This allows the clothing 13 to be fastened in the clothing fastening portion. In this embodiment, the hook portion may be formed by fitting the tip end of the sharply protruding portion 2 into the fitting hole 8 on the receiver 7, thereby allowing the clothing 13 to be fastened in the clothing fastening portion.

In any of the embodiments described above in FIGS. 1 through 4, there is no need of providing the button holes on the right end side of the front main section 10 and on the left end side of the front main section 11 which are to be fastened together as shown in FIGS. 2 and 4.

Thus, the user of the clothing ornaments 3, 3' that can be used as the clothing fasteners in the current embodiment will be able to fasten the clothing at any point where it is desired to fasten the clothing 13.

For any conventional prior art clothing 13. the buttonholes had to be provided, through which the fastening members such as buttons and the like were to be inserted. For the clothing ornaments 3, 3' that can be used as the clothing fasteners in the embodiment of the present invention, however, it may be understood from the foregoing description that there is no need of providing the buttonholes at the point where the clothing 13 is to be fastened.

In accordance with the combination of the clothing ornaments 3, 3' that can be used as the clothing fasteners in any of the embodiments and the clothing 13, therefore, the clothing that has the new concept and the new design and for which there is no need of providing the buttonholes on the clothing can be offered. Such combination has not been found in any conventional prior art combination.

It may also be understood from the foregoing description that the button-like base portion 1 of the clothing ornament 3, 3' which can be used as the clothing fastener has its surface 1*a* that presents, as the decorative surface, the variously colored objects, the variously patterned objects, the variously designed objects or any other similar objects. The clothing ornaments 3, 3' that can be used as the clothing fasteners in the respective embodiments can thus be used to fasten the clothing 13.

The clothing that provides the new concept and the new designs and on which the clothing fastening members such as the buttonholes are not provided may be combined with the clothing ornaments 3, 3' described above in the respective embodiment. Such combination has not been found in any conventional prior art combination and provides the more highly enhanced decorative effects for the clothing 13.

The button-like base portion 1 onto which the particular decorations may be applied and that may meet the needs of TPO (Time, Place, Occasion) can be selected and worn.

It is also apparent from the foregoing description that the clothing on which the fastening members such as the buttonholes are not provided in the clothing fastening portion can be used as the reversible clothing or may be used by either of both sexes, male or female, (which is called as the unisex clothing).

As it is clear from the above description, the combination of the clothing ornaments 3, 3' that can be used as the clothing fasteners and the clothing 13 provides the opportunities for the user to select the new conceptual, newly designed and fissionable clothing that has not been found in any conventional prior art combinations.

Although the present invention has been described with reference to the specific embodiments of the present invention by referring to the accompanying drawings, it should be understood that the present invention is not limited to those embodiments and various modifications or changes may be made without departing from the spirit and scope of the invention as defined in the appended claims.

DESCRIPTION OF REFERENCE NUMERALS

The following is a list of the reference numerals referred to in the specification and the accompanying drawings:

1 button-like base portion
1*a* surface of the button-like base portion
2 sharply protruding portion
3, 3' clothing ornaments that can be used as the clothing fasteners
4 tip end side of the sharply protruding portion
7 receiver
8 fitting hole
10, 11 front main sections of the clothing
13 clothing

The invention claimed is:

1. A combination of a clothing and ornaments for the clothing, wherein said ornaments for the clothing can be used as fasteners for the clothing, said clothing comprises a first front main section and a second front main section, said clothing including a first clothing fastening portion provided on a first end edge of the first front main section and a second clothing fastening portion provided on a second end edge on the second front main section, said first end edge and said second end edge are configured to overlap each other when said clothing is worn on a human body, and said fastening portions have no button insertion holes therein;

each of said ornaments for the clothing comprising:

a button-like base portion having an ornamental or a decorative surface on a front side thereof; and a sharply protruding portion extending from the rear side of the button-like base portion and having a hook portion formed at a tip end of the sharply protruding portion; and when the clothing and ornaments are being worn by the human, said sharply protruding portion extends through the first clothing fastening portion from a front side to a rear side of said first clothing fastening portion and then from a front side to a rear side of said second clothing fastening portion.

2. The combination of the clothing and the ornaments for the clothing as defined in claim 1, wherein the hook portion formed at the tip end of said sharply protruding portion is mounted to the tip end of said sharply protruding portion and serves as a receiver for preventing said sharply protruding portion from being pulled out from the rear side toward the front side of said clothing fastening portions.

3. The combination of the clothing and the ornaments for the clothing as defined in claim 1, wherein the hook portion formed at the tip end of said sharply protruding portion has a tip end that is deformable or bendable and by causing the tip end side to become deformed or bent, it will, prevent said sharply protruding portion from being pulled out from the rear side toward the front side of said clothing fastening portions.

4. The combination of the clothing and the ornaments for the clothing as defined in claim 1, wherein the hook portion formed at the tip end of said sharply protruding portion includes an L-shaped bend.

5. The combination of the clothing and the ornaments for the clothing as defined in claim 1, wherein the hook portion formed at the tip end of said sharply protruding portion includes a coiled portion.

* * * * *